US011668499B2

(12) United States Patent
Bittner

(10) Patent No.: US 11,668,499 B2
(45) Date of Patent: Jun. 6, 2023

(54) REFRIGERATION SYSTEM WITH ADIABATIC ELECTROSTATIC COOLING DEVICE

(71) Applicant: Hill Phoenix, Inc., Conyers, GA (US)

(72) Inventor: John D. Bittner, Conyers, GA (US)

(73) Assignee: Hill Phoenix, Inc., Conyers, GA (US)

( * ) Notice: Subject to any disclaimer, the term of this patent is extended or adjusted under 35 U.S.C. 154(b) by 0 days.

(21) Appl. No.: 17/677,679

(22) Filed: Feb. 22, 2022

(65) Prior Publication Data

US 2022/0178594 A1 Jun. 9, 2022

Related U.S. Application Data

(63) Continuation of application No. 16/878,730, filed on May 20, 2020, now Pat. No. 11,287,165.

(51) Int. Cl.
*F25B 39/02* (2006.01)
*F25B 49/02* (2006.01)

(52) U.S. Cl.
CPC ..... *F25B 39/022* (2013.01); *F25B 49/022* (2013.01); *F25B 2339/021* (2013.01); *F25B 2500/14* (2013.01)

(58) Field of Classification Search
CPC ..... F25B 39/022; F25B 49/022; F25B 2339/021; F25B 2339/041; F25B 2500/14; F24F 1/42; F24F 6/12; F24F 6/14
See application file for complete search history.

(56) References Cited

U.S. PATENT DOCUMENTS

| | | | |
|---|---|---|---|
| 4,548,262 | A | 10/1985 | Hull |
| 4,662,902 | A | 5/1987 | Meyer-Pittroff |
| 5,056,593 | A | 10/1991 | Hull |
| 5,309,726 | A | 5/1994 | Asbridge |
| 7,150,412 | B2 | 12/2006 | Wang et al. |
| 7,310,958 | B2 | 12/2007 | Carter et al. |
| 8,033,485 | B2 | 10/2011 | Yamaguchi |

(Continued)

FOREIGN PATENT DOCUMENTS

WO WO 2017082714 5/2017

OTHER PUBLICATIONS

Electrostatic Spraying Systems, Inc.,—the Technology, copyright 2015, located at http;//maxcharge.com/technology/, 5 pages.

(Continued)

*Primary Examiner* — Elizabeth J Martin
(74) *Attorney, Agent, or Firm* — Fish & Richardson P.C.

(57) ABSTRACT

An evaporative cooling device for a refrigeration system includes one or more heat exchanger coils, a first moisture panel, a second moisture panel, a first nozzle array, a second nozzle array, a moisture sensor, and a controller. The first moisture panel and the second moisture panel are separated by a distance and disposed external to the one or more heat exchanger coils. The first nozzle array is disposed external to the first moisture panel and the second nozzle array is disposed external to the second moisture panel. The first nozzle array and the second nozzle array are configured to provide an atomized spray of electrostatically charged droplets. The moisture sensor is configured to provide a signal representative of a moisture level. The controller is configured to receive the signal representative of the moisture level and control a supply of water.

36 Claims, 6 Drawing Sheets

(56) References Cited

U.S. PATENT DOCUMENTS

| | | | | |
|---|---|---|---|---|
| 8,757,522 | B2 | 6/2014 | Tsuji et al. | |
| 8,991,203 | B2 | 3/2015 | Okabe et al. | |
| 9,546,804 | B2 | 1/2017 | Troutman et al. | |
| 10,132,577 | B2 | 11/2018 | Martell et al. | |
| 11,287,165 | B2 | 3/2022 | Bittner | |
| 2005/0000683 | A1 | 1/2005 | Hall et al. | |
| 2006/0162354 | A1* | 7/2006 | Jensen | F24F 1/06 62/171 |
| 2008/0115921 | A1 | 5/2008 | Hall et al. | |
| 2009/0266516 | A1 | 10/2009 | Jewell-Larsen et al. | |
| 2010/0162737 | A1 | 7/2010 | Hall et al. | |
| 2013/0264048 | A1 | 10/2013 | Matracea et al. | |
| 2014/0263765 | A1* | 9/2014 | You | F24F 1/42 239/690 |
| 2016/0252313 | A1 | 9/2016 | Ziegltrum | |
| 2018/0224174 | A1 | 8/2018 | Hollander et al. | |
| 2018/0283814 | A1 | 10/2018 | Najafifard | |
| 2018/0372387 | A1 | 12/2018 | Echols | |
| 2019/0376728 | A1 | 12/2019 | Hayes et al. | |
| 2021/0364198 | A1 | 11/2021 | Bittner | |

OTHER PUBLICATIONS

International Preliminary Report on Patentability in International Appln. No. PCT/US2021/033114, dated Dec. 1, 2022, 8 pages.
International Search Report and Written Opinion in International Appln. No. PCT/US2021/033114, dated Sep. 1, 2021, 10 pages.

* cited by examiner

REFRIGERATION SYSTEM WITH ADIABATIC ELECTROSTATIC COOLING DEVICE

CROSS-REFERENCE TO RELATED APPLICATIONS

This application is a continuation application of and claims priority under 35 U.S.C. § 120 to U.S. application Ser. No. 16/878,730, filed on May 20, 2020, the contents of which is hereby incorporated by reference.

TECHNICAL FIELD

The present application relates generally to a refrigeration system with an adiabatic electrostatic cooling device, such as a gas cooler, fluid cooler, or condenser.

BACKGROUND

Refrigeration systems are often used to provide cooling to temperature controlled display devices (e.g., cases, merchandisers, etc.) in supermarkets and other similar facilities. Vapor compression refrigeration systems are a type of refrigeration system which provide such cooling by circulating a fluid refrigerant (e.g., a liquid and/or vapor) through a thermodynamic vapor compression cycle. In a vapor compression cycle, the refrigerant is typically (1) compressed to a high temperature/pressure state (e.g., by a compressor of the refrigeration system), (2) cooled/condensed to a lower temperature state (e.g., in a gas cooler or condenser which absorbs heat from the refrigerant), (3) expanded to a lower pressure (e.g., through an expansion valve), and (4) evaporated to provide cooling by absorbing heat into the refrigerant.

SUMMARY

At least one aspect of the present disclosure is directed to an evaporative cooling device for a refrigeration system. The system includes one or more heat exchanger coils. The system includes a first moisture panel disposed external to the one or more heat exchanger coils. The system includes a second moisture panel disposed external to the one or more heat exchanger coils. The second moisture panel is separated from the first moisture panel by a distance. The system includes a first nozzle array disposed external to the first moisture panel and configured to provide an atomized spray of electrostatically charged droplets to the first moisture panel. The system includes a second nozzle array disposed external to the second moisture panel and configured to provide an atomized spray of electrostatically charged droplets to the second moisture panel. The system includes a moisture sensor configured to provide a signal representative of a moisture level from at least one of the first moisture panel or the second moisture panel. The system includes a controller communicatively coupled to the moisture sensor. The controller is configured to receive the signal representative of the moisture level from at least one of the first moisture panel or the second moisture panel. The controller is configured to control a supply of water to at least one of the first moisture panel or the second moisture panel in response to the signal representative of the moisture level.

Another aspect of the present disclosure is directed to a $CO_2$ refrigeration system with an adiabatic gas cooler with electrostatically charged cooling spray. The $CO_2$ refrigeration system includes a $CO_2$ refrigerant circuit including an evaporator, a compressor, a gas cooler, a receiver, and an expansion valve. The gas cooler includes one or more cooling coils. The gas cooler includes one or more moisture pads adjacent to the one or more cooling coils. The gas cooler includes one or more spray nozzles configured to wet the one or more moisture pads with electrostatically charged water droplets. The gas cooler includes a moisture sensor associated with the one or more moisture pads. The moisture sensor is operable to provide a signal representative of a moisture level of the one or more moisture pads. The gas cooler includes a controller. The controller is configured to receive the signal representative of the moisture level of the one or more moisture pads. The controller is configured to control a supply of water to the one or more moisture pads in response to the signal representative of the moisture level.

Another aspect of the present disclosure is directed to a method of providing an evaporative cooling device for a refrigeration system. The method includes providing one or more heat exchanger coils. The method includes installing a first moisture panel external to the one or more heat exchanger coils. The method includes installing a second moisture panel external to the one or more heat exchanger coils. The second moisture panel is separated from the first moisture panel by a distance. The method includes installing a first nozzle array external to the first moisture panel. The method includes configuring the first nozzle array to provide an atomized spray of electrostatically charged droplets to the first moisture panel. The method includes installing a second nozzle array external to the second moisture panel. The method includes configuring the second nozzle array to provide an atomized spray of electrostatically charged droplets to the second moisture panel. The method includes configuring a moisture sensor to provide a signal representative of a moisture level from at least one of the first moisture panel or the second moisture panel. The method includes providing a controller communicatively coupled to the moisture sensor. The method includes receiving, by the controller, the signal representative of the moisture level from at least one of the first moisture panel or the second moisture panel. The method includes controlling, by the controller, a supply of water to at least one of the first moisture panel or the second moisture panel in response to the signal representative of the moisture level.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

BRIEF DESCRIPTION OF THE DRAWINGS

The details of one or more implementations of the subject matter described in this specification are set forth in the accompanying drawings and the description below. Other features, aspects, and advantages of the subject matter will become apparent from the description, the drawings, and the claims.

Like reference numbers and designations in the various drawings indicate like elements.

DETAILED DESCRIPTION

Figure 1:
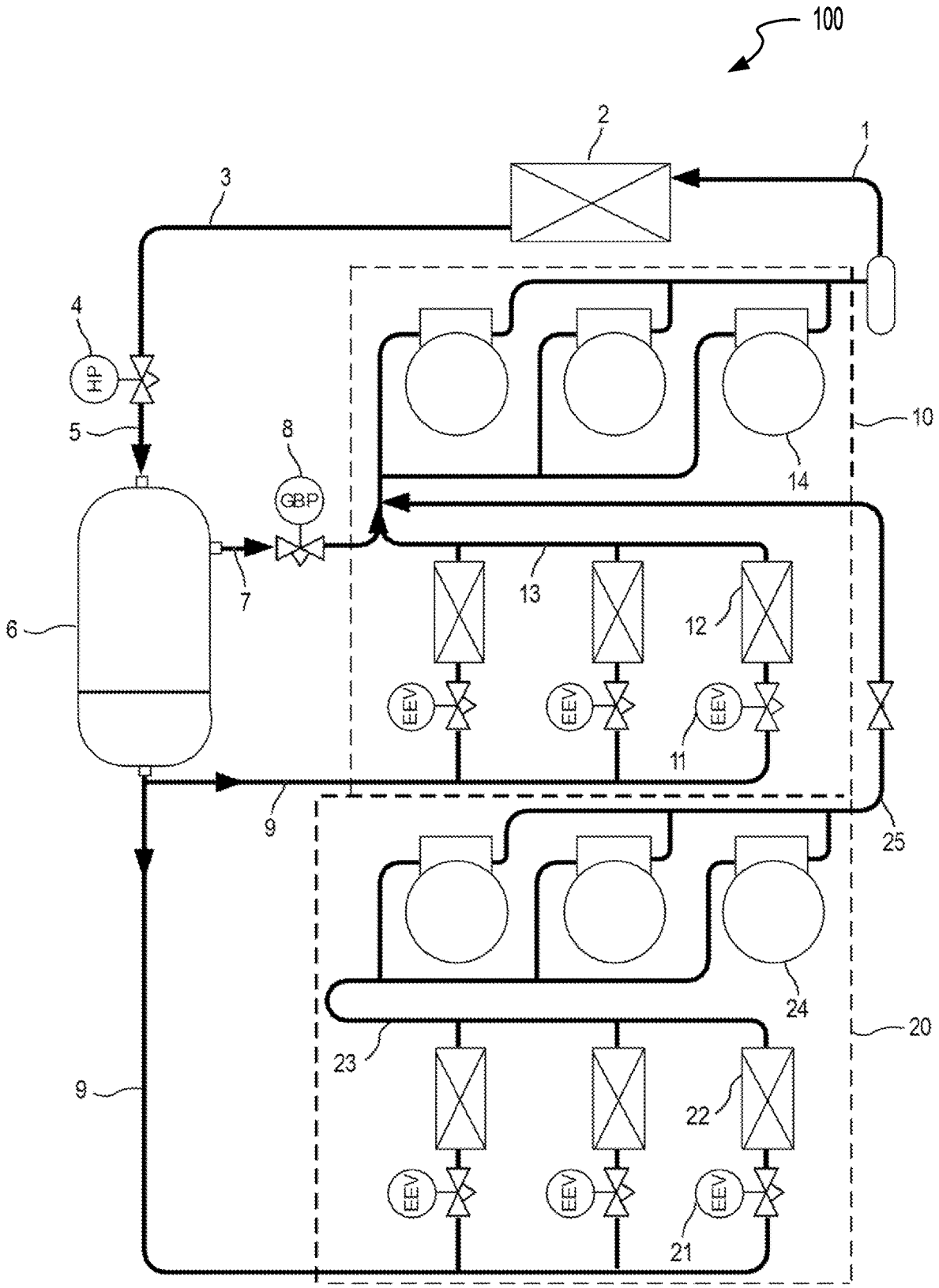
FIG. 1 is a schematic representation of a $CO_2$ refrigeration system having a $CO_2$ refrigeration circuit, a receiving tank for containing a mixture of liquid and vapor $CO_2$ refrigerant, and a gas bypass valve fluidly connected with the receiving tank for controlling a pressure within the receiving tank, according to an exemplary embodiment.

Following below are more detailed descriptions of various concepts related to, and implementations of, methods, apparatuses, and for providing cooling using an evaporative cooling device. The various concepts introduced above and discussed in greater detail below may be implemented in any of a number of ways, as the described concepts are not limited to any particular manner of implementation. Examples of specific implementations and applications are provided primarily for illustrative purposes.

Overview

Providing a target, such as a temperature controlled case, with cooling is often performed in order to store products, such as refrigerated goods or frozen goods, in the target. In some applications, the target is cooled by a cooling system which circulates a refrigerant through a circuit path and includes a gas cooler for cooling or condensing a high-temperature refrigerant. The gas cooler may include heat exchanger coils and moisture pads. The moisture pads may be wetted with a device which drips water down through the moisture pads.

In some situations, the cooling systems generate excess water and runoff from the moisture pads which may be drained or recirculated back to drip-emitters at the top of the moisture pads. For example, the water flowing through the moisture pads may not be completely absorbed by the moisture pads or evaporated by the airflow drawn through the pads. As a result, the amount of water necessary for the moisture pads to be adequately wetted and able to provide sufficient cooling may require excess water to flow through the moisture pads. In another situation, spraying water droplets on the moisture pads may cause water to "blow-through" the moisture pad, which decreases efficiency and creates excess runoff, which may result in coil saturation, which leads to formation of scale, corrosion materials, etc.

Implementations described herein are related to a cooling device for a refrigeration system. The cooling device includes a water supply line feeding electrostatic spray nozzles that atomize the water droplets and electrostatically charge the droplets. Electrostatically charging the droplets may provide improved moisture pad coverage and water retention on the moisture pads, as the droplets are capable of being attracted to oppositely charged moisture pads. The cooling device may include a moisture sensing element which provides a feedback signal to a variable flowrate control device on the water supply line to the nozzles to minimize water usage and runoff.

II. Example Adiabatic Gas Cooler

Referring generally to the FIGURES, the refrigeration system is shown by way of examples as a $CO_2$ refrigeration system and components thereof, according to various exemplary embodiments. The $CO_2$ refrigeration system may be a vapor compression refrigeration system which uses primarily carbon dioxide (i.e., $CO_2$ ) as a refrigerant. In some implementations, the $CO_2$ refrigeration system may be used to provide cooling for temperature controlled display devices in a supermarket or other similar facility. The $CO_2$ refrigeration system can include a $CO_2$ refrigerant circuit. The $CO_2$ refrigerant circuit can include evaporators, low-temperature (LT) and medium-temperature (MT) compressors, gas coolers, a receiver, and expansion valves. The $CO_2$ refrigerant circuit can be configured to circulate $CO_2$ as a refrigerant to provide cooling to the evaporators.

In some embodiments, the $CO_2$ refrigeration system includes a receiving tank (e.g., a flash tank, a refrigerant reservoir, etc.) containing a mixture of $CO_2$ liquid and $CO_2$ vapor, a gas bypass valve, and a parallel compressor. The gas bypass valve may be arranged in series with one or more MT compressors of the $CO_2$ refrigeration system. The gas bypass valve provides a mechanism for controlling the $CO_2$ refrigerant pressure within the receiving tank by venting excess $CO_2$ vapor to the suction side of the $CO_2$ refrigeration system MT compressors. The parallel compressor may be arranged in parallel with both the gas bypass valve and with other compressors of the $CO_2$ refrigeration system. The parallel compressor provides an alternative or supplemental means for controlling the pressure within the receiving tank.

Advantageously, the $CO_2$ refrigeration system includes a controller for monitoring and controlling the pressure, temperature, and/or flow of the $CO_2$ refrigerant throughout the $CO_2$ refrigeration system. The controller can operate both the gas bypass valve and the parallel compressor (e.g., according to the various control processes described herein) to efficiently regulate the pressure of the $CO_2$ refrigerant within the receiving tank. Additionally, the controller can interface with other instrumentation associated with the $CO_2$ refrigeration system (e.g., measurement devices, timing devices, pressure sensors, temperature sensors, etc.) and provide appropriate control signals to a variety of operable components of the $CO_2$ refrigeration system (e.g., compressors, valves, power supplies, flow diverters, etc.) to regulate the pressure, temperature, and/or flow at other locations within the $CO_2$ refrigeration system. Advantageously, the controller may be used to facilitate efficient operation of the $CO_2$ refrigeration system, reduce energy consumption, and improve system performance.

Before discussing further details of the $CO_2$ refrigeration system and/or the components thereof, it should be noted that references to "front," "back," "rear," "upward," "downward," "inner," "outer," "right," and "left" in this description are merely used to identify the various elements as they are oriented in the FIGURES. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids, transmission of forces, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Referring now to FIG. 1, a $CO_2$ refrigeration system 100 is shown according to an exemplary embodiment. According to other embodiments, the refrigeration system may be configured to use other refrigerants, such as hydrofluorocarbons, ammonia, etc., and associate cooling device such as condensers, fluid coolers, etc. The illustrated $CO_2$ refrigeration system 100 may be a vapor compression refrigeration system which uses primarily carbon dioxide as a refrigerant. $CO_2$ refrigeration system 100 and is shown to include a system of pipes, conduits, or other fluid channels (e.g., fluid conduits 1, 3, 5, 7, and 9) for transporting the carbon dioxide between various thermodynamic components of the refrigeration system. The thermodynamic components of $CO_2$ refrigeration system 100 are shown to include a gas cooler/condenser 2, a high pressure valve 4, a receiving tank 6, a gas bypass valve 8, a medium-temperature ("MT") system portion 10, and a low-temperature ("LT") system portion 20.

Gas cooler/condenser 2 may be a heat exchanger, fan-coil unit, or other similar device for removing heat from the $CO_2$ refrigerant. According to other embodiments that may use different refrigerants, the gas cooler/condenser may be a fluid cooler or condensing unit. Gas cooler/condenser 2 is shown receiving $CO_2$ vapor from fluid conduit 1. In some embodiments, the $CO_2$ vapor in fluid conduit 1 may have a pressure within a range from approximately 45 bar to approximately 100 bar (i.e., about 640 psig to about 1420 psig), depending on ambient temperature and other operating conditions. In some embodiments, gas cooler/condenser 2 may partially or fully condense $CO_2$ vapor into liquid $CO_2$ (e.g., if system operation is in a subcritical region). The condensation process may result in fully saturated $CO_2$ liquid or a liquid-vapor mixture (e.g., having a thermodynamic quality between 0 and 1). In other embodiments, gas cooler/condenser 2 may cool the $CO_2$ vapor (e.g., by removing superheat) without condensing the $CO_2$ vapor into $CO_2$ liquid (e.g., if system operation is in a supercritical region). In some embodiments, the cooling/condensation process is an isobaric process. Gas cooler/condenser 2 is shown outputting the cooled and/or condensed $CO_2$ refrigerant into fluid conduit 3. The gas cooler/condenser 2 may include the evaporative gas cooler described herein.

High pressure valve 4 receives the cooled and/or condensed $CO_2$ refrigerant from fluid conduit 3 and outputs the $CO_2$ refrigerant to fluid conduit 5. High pressure valve 4 may control the pressure of the $CO_2$ refrigerant in gas cooler/condenser 2 by controlling an amount of $CO_2$ refrigerant permitted to pass through high pressure valve 4. In some embodiments, high pressure valve 4 is a high pressure thermal expansion valve (e.g., if the pressure in fluid conduit 3 is greater than the pressure in fluid conduit 5). In such embodiments, high pressure valve 4 may allow the $CO_2$ refrigerant to expand to a lower pressure state. The expansion process may be an isenthalpic and/or adiabatic expansion process, resulting in a flash evaporation of the high pressure $CO_2$ refrigerant to a lower pressure, lower temperature state. The expansion process may produce a liquid/vapor mixture (e.g., having a thermodynamic quality between 0 and 1). In some embodiments, the $CO_2$ refrigerant expands to a pressure of approximately 38 bar (e.g., about 540 psig), which corresponds to a temperature of approximately 37° F. The $CO_2$ refrigerant then flows from fluid conduit 5 into receiving tank 6.

Receiving tank 6 (e.g., receiver, receiver tank, etc.) collects the $CO_2$ refrigerant from fluid conduit 5. In some embodiments, receiving tank 6 may be a flash tank or other fluid reservoir. Receiving tank 6 includes a $CO_2$ liquid portion and a $CO_2$ vapor portion and may contain a partially saturated mixture of $CO_2$ liquid and $CO_2$ vapor. In some embodiments, receiving tank 6 separates the $CO_2$ liquid from the $CO_2$ vapor. The $CO_2$ liquid may exit receiving tank 6 through fluid conduits 9. Fluid conduits 9 may be liquid headers leading to either MT system portion 10 or LT system portion 20. The $CO_2$ vapor may exit receiving tank 6 through fluid conduit 7. Fluid conduit 7 is shown leading the $CO_2$ vapor to gas bypass valve 8.

Gas bypass valve 8 is shown receiving the $CO_2$ vapor from fluid conduit 7 and outputting the $CO_2$ refrigerant to MT system portion 10. In some embodiments, gas bypass valve 8 may be operated to regulate or control the pressure within receiving tank 6 (e.g., by adjusting an amount of $CO_2$ refrigerant permitted to pass through gas bypass valve 8). For example, gas bypass valve 8 may be adjusted (e.g., variably opened or closed) to adjust the mass flow rate, volume flow rate, or other flow rates of the $CO_2$ refrigerant through gas bypass valve 8. Gas bypass valve 8 may be opened and closed (e.g., manually, automatically, by a controller, etc.) as needed to regulate the pressure within receiving tank 6.

In some embodiments, gas bypass valve 8 includes a sensor for measuring a flow rate (e.g., mass flow, volume flow, etc.) of the $CO_2$ refrigerant through gas bypass valve 8. In other embodiments, gas bypass valve 8 includes an indicator (e.g., a gauge, a dial, etc.) from which the position of gas bypass valve 8 may be determined. This position may be used to determine the flow rate of $CO_2$ refrigerant through gas bypass valve 8, as such quantities may be proportional or otherwise related.

In some embodiments, gas bypass valve 8 may be a thermal expansion valve (e.g., if the pressure on the downstream side of gas bypass valve 8 is lower than the pressure in fluid conduit 7). According to one embodiment, the pressure within receiving tank 6 is regulated by gas bypass valve 8 to a pressure of approximately 38 bar, which corresponds to about 37° F. Advantageously, this pressure/temperature state (i.e., approximately 38 bar, approximately 37° F.). may facilitate the use of copper tubing/piping for the downstream $CO_2$ lines of the system. Additionally, this pressure/temperature state may allow such copper tubing to operate in a substantially frost-free manner.

Still referring to FIG. 1, MT system portion 10 is shown to include one or more expansion valves 11, one or more MT evaporators 12, and one or more MT compressors 14. In various embodiments, any number of expansion valves 11, MT evaporators 12, and MT compressors 14 may be present. Expansion valves 11 may be electronic expansion valves or other similar expansion valves. Expansion valves 11 are shown receiving liquid $CO_2$ refrigerant from fluid conduit 9 and outputting the $CO_2$ refrigerant to MT evaporators 12. Expansion valves 11 may cause the $CO_2$ refrigerant to undergo a rapid drop in pressure, thereby expanding the $CO_2$ refrigerant to a lower pressure, lower temperature state. In some embodiments, expansion valves 11 may expand the $CO_2$ refrigerant to a pressure of approximately 30 bar. The expansion process may be an isenthalpic and/or adiabatic expansion process.

MT evaporators 12 are shown receiving the cooled and expanded $CO_2$ refrigerant from expansion valves 11. In some embodiments, MT evaporators may be associated with display cases/devices (e.g., if $CO_2$ refrigeration system 100 is implemented in a supermarket setting). MT evaporators 12 may be configured to facilitate the transfer of heat from the display cases/devices into the $CO_2$ refrigerant. The added heat may cause the $CO_2$ refrigerant to evaporate partially or completely. According to one embodiment, the $CO_2$ refrigerant is fully evaporated in MT evaporators 12. In some embodiments, the evaporation process may be an isobaric process. MT evaporators 12 are shown outputting the $CO_2$ refrigerant via fluid conduits 13, leading to MT compressors 14.

MT compressors 14 compress the $CO_2$ refrigerant into a superheated vapor having a pressure within a range of approximately 45 bar to approximately 100 bar. The output pressure from MT compressors 14 may vary depending on ambient temperature and other operating conditions. In some embodiments, MT compressors 14 operate in a transcritical mode. In operation, the $CO_2$ discharge gas exits MT compressors 14 and flows through fluid conduit 1 into gas cooler/condenser 2.

Still referring to FIG. 1, LT system portion 20 is shown to include one or more expansion valves 21, one or more LT evaporators 22, and one or more LT compressors 24.

In various embodiments, any number of expansion valves 21, LT evaporators 22, and LT compressors 24 may be present. In some embodiments, LT system portion 20 may be omitted and the $CO_2$ refrigeration system 100 may operate with an air conditioning (AC) module interfacing with only MT system 10.

Expansion valves 21 may be electronic expansion valves or other similar expansion valves. Expansion valves 21 are shown receiving liquid $CO_2$ refrigerant from fluid conduit 9 and outputting the $CO_2$ refrigerant to LT evaporators 22. Expansion valves 21 may cause the $CO_2$ refrigerant to undergo a rapid drop in pressure, thereby expanding the $CO_2$ refrigerant to a lower pressure, lower temperature state. The expansion process may be an isenthalpic and/or adiabatic expansion process. In some embodiments, expansion valves 21 may expand the $CO_2$ refrigerant to a lower pressure than expansion valves 11, thereby resulting in a lower temperature $CO_2$ refrigerant. Accordingly, LT system portion 20 may be used in conjunction with a freezer system or other lower temperature display cases.

LT evaporators 22 are shown receiving the cooled and expanded $CO_2$ refrigerant from expansion valves 21. In some embodiments, LT evaporators may be associated with display cases/devices (e.g., if $CO_2$ refrigeration system 100 is implemented in a supermarket setting). LT evaporators 22 may be configured to facilitate the transfer of heat from the display cases/devices into the $CO_2$ refrigerant. The added heat may cause the $CO_2$ refrigerant to evaporate partially or completely. In some embodiments, the evaporation process may be an isobaric process. LT evaporators 22 are shown outputting the $CO_2$ refrigerant via fluid conduit 23, leading to LT compressors 24.

LT compressors 24 compress the $CO_2$ refrigerant. In some embodiments, LT compressors 24 may compress the $CO_2$ refrigerant to a pressure of approximately 30 bar (e.g., about 425 psig) having a saturation temperature of approximately 23° F. (e.g., about −5° C.). LT compressors 24 are shown outputting the $CO_2$ refrigerant through fluid conduit 25. Fluid conduit 25 may be fluidly connected with the suction (e.g., upstream) side of MT compressors 14.

In some embodiments, the $CO_2$ vapor that is bypassed through gas bypass valve 8 is mixed with the $CO_2$ refrigerant gas exiting MT evaporators 12 (e.g., via fluid conduit 13). The bypassed $CO_2$ vapor may also mix with the discharge $CO_2$ refrigerant gas exiting LT compressors 24 (e.g., via fluid conduit 25). The combined $CO_2$ refrigerant gas may be provided to the suction side of MT compressors 14.

Figure 2:
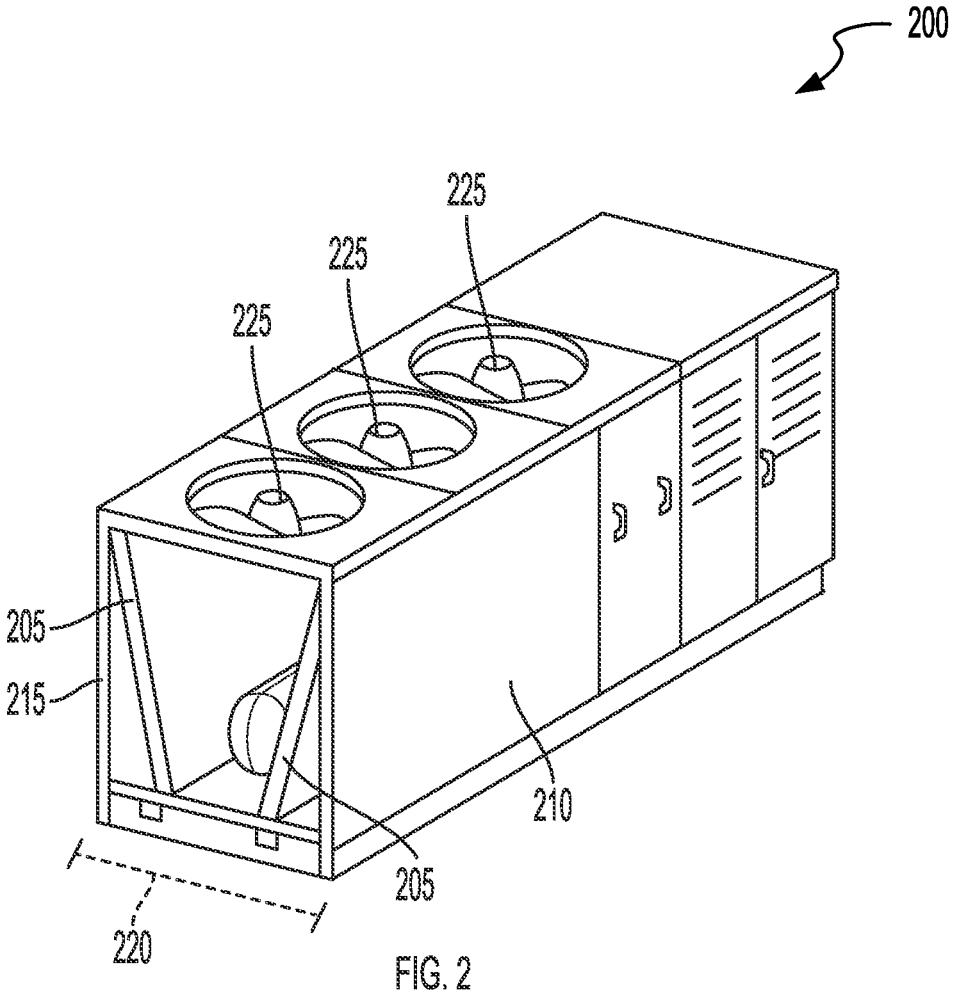
FIG. 2 is a schematic representation of an adiabatic gas cooler, according to an exemplary embodiment.

Referring now to FIG. 2, a refrigerant cooling device shown as a gas cooler 200 (e.g., adiabatic gas cooler, evaporative gas cooler, adiabatic gas condenser, evaporative gas condenser, gas condenser, etc.) is shown according to an exemplary embodiment. The gas cooler 200 can include the gas cooler/condenser 2 described above. The gas cooler 200 may include one or more heat exchanger coils 205. For example, the heat exchanger coil 205 can include a coil, microchannel coil, condenser coil, tube coil, cooling coil, or fin coil. The heat exchanger coil 205 can include multiple tubes through which refrigerant flows. The heat exchanger coil 205 can receive ambient cool air drawn over the heat exchanger coil 205 by a fan. According to one embodiment, the gas cooler 200 may include a plurality of heat exchanger coils 205. The heat exchanger coil 205 may be arranged in a "V" shape.

To enhance the cooling efficiency of heat exchanger coils 205, the gas cooler 200 may include one or more moisture panels such as a first moisture panel 210 and a second moisture panel 215. The first moisture panel 210 (e.g., first adiabatic panel, first adiabatic pad, first adiabatic moisture pad, first moisture pad, first cooling pad, etc.) can be disposed external to the heat exchanger coils 205. The first moisture panel 210 may be used to generate pre-cooled air by an evaporative cooling process. For example, ambient air may pass through the first moisture panel 210 before the ambient air passes through the heat exchanger coils 205. As the ambient air passes through the first moisture panel 210, the ambient air cools as the moisture in the first moisture panel 210 evaporates and becomes pre-cooled air. The gas cooler 200 may include one or more moisture pads adjacent to the one or more cooling coils. For example, a plurality of moisture pads can be disposed adjacent to a plurality of cooling coils. According to the illustrated embodiment of FIG. 2, the first moisture panel 210 is disposed outwardly and co-extensively with each heat exchanger coil 205. The first moisture panel 210 can provide an evaporative cooling effect when air is drawn through the first moisture panel 210. The first moisture panel 210 can increase the cooling efficiency of the heat exchanger coils 205.

In addition, the gas cooler 200 may include a second moisture panel 215 (e.g., second adiabatic panel, second adiabatic pad, second adiabatic moisture pad, second moisture pad, second cooling pad, etc.) disposed external to the heat exchanger coils 205. The second moisture panel 215 may be used to generate pre-cooled air by an evaporative cooling process. For example, ambient air may pass through the second moisture panel 215 before the ambient air passes through the heat exchanger coils 205. As the ambient air passes through the second moisture panel 215, the ambient air cools as the moisture in the second moisture panel 215 evaporates and becomes pre-cooled air. According to the illustrated embodiment of FIG. 2, the second moisture panel 215 is disposed outwardly and co-extensively with each heat exchanger coil 205. The second moisture panel 215 can provide an evaporative cooling effect when air is drawn through the second moisture panel 215. The second moisture panel 215 can increase the cooling efficiency of the heat exchanger coils 205.

The second moisture panel 215 can be separated from the first moisture panel 210 by a distance 220. For example, the first moisture panel 210 can be separated from the second moisture panel 215 by a distance 220 at a base of the first moisture panel 210 and a base of the second moisture panel 215. The first moisture panel 210 can be separated from the second moisture panel 215 by a distance 220 at a center of the first moisture panel 210 and a center of the second moisture panel 215. The first moisture panel 210 can be separated from the second moisture panel 215 by a distance 220 at a top of the first moisture panel 210 and a top of the second moisture panel 215.

The gas cooler 200 may also include one or more fans 225. The fans 225 draw ambient air or pre-cooled air through the heat exchanger coils 205, thereby cooling and condensing the refrigerant and providing cooling to the $CO_2$ refrigeration system 100. The gas cooler 200 may include one or more motors that power the fans 225. The fans 225 draw air through moisture panels and subsequently through the heat exchanger coils 205. The fans 225 are shown located above the heat exchanger coils 205. The first moisture panel 210 can provide an evaporative cooling effect to the heat exchanger coil 205 when air is drawn through the first moisture panel 210 by the fans 225. The second moisture panel 215 can provide an evaporative cooling effect to the heat exchanger coil 205 when air is drawn through the second moisture panel 215 by the fans 225.

Figure 3:
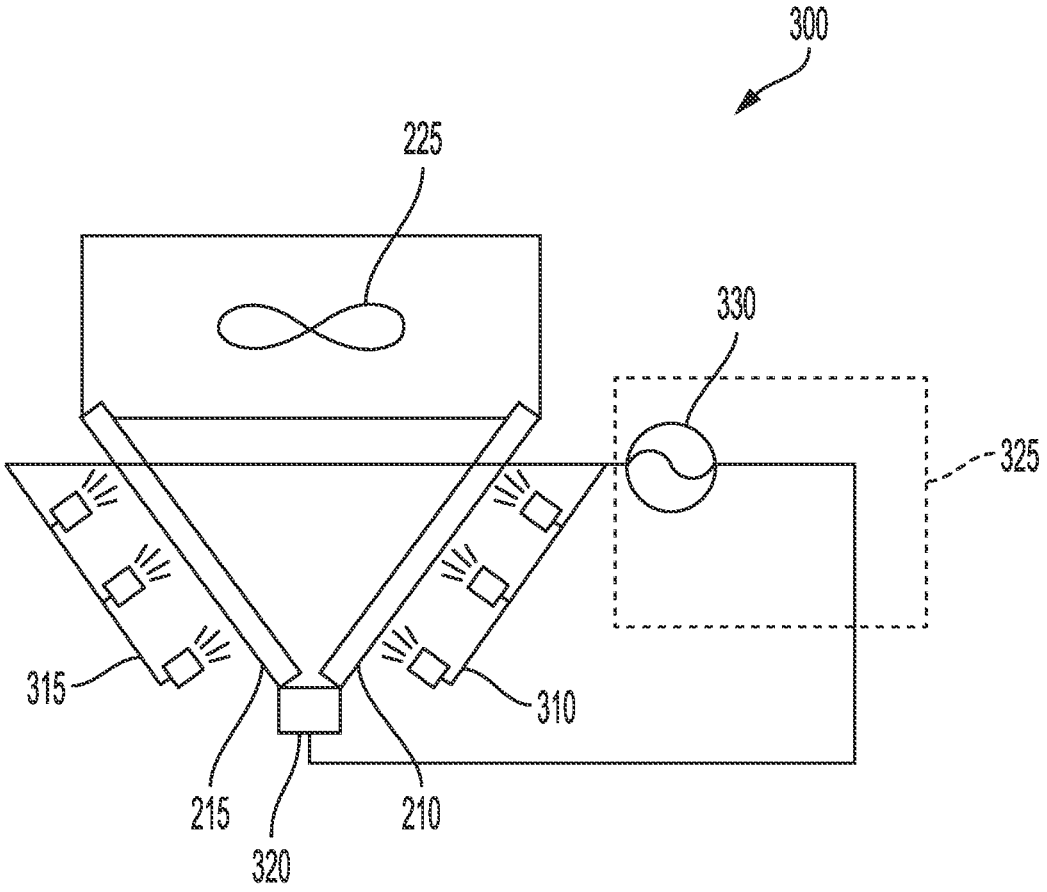
FIG. 3 is a schematic representation of a cross-section of an adiabatic gas cooler, according to an exemplary embodiment.

Referring now to FIG. 3, a cross-section 300 of a gas cooler 200 is shown according to an exemplary embodiment. The gas cooler 200 can include a first nozzle array 310 (e.g., first water spray nozzle array, one or more spray nozzles, etc.). The first nozzle array 310 can be disposed external to the first moisture panel 210. For example, the first nozzle array 310 can be located on the exterior of the first moisture panel 210. The first nozzle array 310 can be configured to provide an atomized spray of electrostatically charged water droplets to the first moisture panel 210. The atomized spray of electrostatically charged water droplets and the first moisture panel 210 are oppositely charged. For example, the first nozzle array 310 can include nozzles, each of which can include a barrel. An electrical charge can be applied to the barrel of each of the nozzles, which applies a charge to the fluid (e.g., water) and/or water droplets. As the fluid is propelled through the nozzle, the water gains an electric charge. For example, the barrel of the nozzle can transfer a negative charge to the droplets (e.g., water droplets, etc.). The first moisture panel 210 can be positively charged (or grounded) to create an attractive force to the droplets. The positively charged first moisture panel 210 can create an attraction to the negatively charged droplets. Alternatively, the barrel of the nozzle can transfer a positive charge to the droplets (e.g., water droplets, etc.) and the first moisture panel 210 can be negatively charged (or grounded). The negatively charged first moisture panel 210 can create an attraction to the positively charged droplets. Electrostatically spraying droplets onto the first moisture panel 210 can allow more water to land on the charged first moisture panel 210. Electrostatically spraying droplets onto the first moisture panel 210 can allow more water to be retained by the first moisture panel 210. Due to the charge, when the water leaves the nozzle, the water is attracted to the first moisture panel 210 and "sticks" (e.g., wets, adheres, etc.) to the first moisture panel 210. The attraction improves coverage of wetting on the moisture panels and minimizes dry spots. The attraction also improves the water efficiency by more effectively covering the surface which results in less water usage. The attraction further reduces "blow-through" of moisture through the moisture panels. For example, the electrostatic attraction of the atomized spray of electrostatically charged droplets and the moisture panels substantially prevents blow-through of droplets beyond an inside surface of the moisture panel.

The gas cooler 200 can include a second nozzle array 315 (e.g., second water spray nozzle array, one or more spray nozzles, etc.). The second nozzle array 315 can be disposed external to the second moisture panel 215. For example, the second nozzle array 315 can be located on the exterior of the second moisture panel 215. The second nozzle array 315 can be configured to provide an atomized spray of electrostatically charged water droplets to the second moisture panel 215. The atomized spray of electrostatically charged water droplets and the second moisture panel 215 are oppositely charged. For example, the second nozzle array 315 can include nozzles, each of which can include a barrel. An electrical charge can be applied to the barrel of each of the nozzles, which applies a charge to the fluid (e.g., water) and/or water droplets. As the fluid is propelled through the nozzle, the water gains an electric charge. For example, the barrel of the nozzle can transfer a negative charge to the droplets (e.g., water droplets, etc.). The second moisture panel 215 can be positively charged (or grounded) to create an attractive force to the droplets. The positively charged second moisture panel 215 can create an attraction to the negatively charged droplets. Alternatively, the barrel of the nozzle can transfer a positive charge to the droplets (e.g., water droplets, etc.) and the second moisture panel 215 can be negatively charged (or grounded). The negatively charged second moisture panel 215 can create an attraction to the positively charged droplets. Electrostatically spraying droplets onto the second moisture panel 215 can allow more water to land on the charged second moisture panel 215. Electrostatically spraying droplets onto the first moisture panel 210 can allow more water to be retained by the second moisture panel 215. Due to the charge, when the water leaves the nozzle, the water is attracted to the second moisture panel 215 and "sticks" (e.g., wets, adheres, etc.) to the second moisture panel 215. In some embodiments, the first nozzle array 310 and the second nozzle array 315 form a single nozzle array.

The gas cooler 200 can also include a moisture sensor 320. The moisture sensor 320 can be configured to provide a signal representative of a moisture level from at least one of the first moisture panel 210 and/or the second moisture panel 215. For example, the moisture sensor 320 can be configured to provide a signal representative of a moisture level from the first moisture panel 210. The moisture sensor 320 can also be configured to provide a signal representative of a moisture level from the second moisture panel 215.

In some embodiments, the moisture level is a first moisture level and the moisture sensor is a first moisture sensor. The first moisture sensor can be configured to provide the signal representative of the first moisture level from the first moisture panel 210. In some embodiments, the gas cooler 200 can include a second moisture sensor. The second moisture sensor can be configured to provide a signal representative of a second moisture level from the second moisture panel 215. The first moisture sensor can be configured to provide the signal representative of the first moisture level from a first moisture pad of the one or more moisture pads. The second moisture sensor can be configured to provide a signal representative of a second moisture level from a second moisture pad of the one or more moisture pads.

In some embodiments, the moisture sensor 320 can be configured to provide the signal representative of the moisture level from at least one of a bottom of the first moisture panel or a bottom of the second moisture panel. For example, the moisture sensor 320 can be configured to provide the signal representative of the moisture level from the bottom of the first moisture panel 210. The moisture sensor 320 can be configured to provide the signal representative of the moisture level from the bottom of the second moisture panel 215. The moisture sensor 320 can be configured to provide the signal representative of the moisture level from a bottom of the one or more moisture pads. In some embodiments, the moisture sensor is configured to provide the signal representative of the moisture level from a drainage receptacle disposed beneath the first moisture panel and the second moisture panel The gas cooler 200 can also include a controller 325. The controller 325 can be communicatively coupled to the moisture sensor 320. The controller 325 can be configured to receive the signal representative of the moisture level from at least one of the first moisture panel 210 or the second moisture panel 215. For example, the controller 325 can be configured to receive the signal representative of the moisture level from the first moisture panel 210 and the moisture level from the second moisture panel 215.

In some embodiments, the controller 325 can receive a signal representative of the first moisture level and compare the signal to a benchmark value. For example, the benchmark value can represent an adequately wetted (e.g., not over-wetted and not under-wetted) first moisture panel 210. The controller 325 can determine that the first moisture level is greater than, less than, or equal to the benchmark value. The controller 325 can be configured to receive the signal representative of the first moisture level from the first moisture pad. The controller 325 can receive a signal representative of the first moisture level and determine if the signal is within a range (e.g., 2%, 5%, 10%, etc.) of a target moisture level.

In some embodiments, the controller 325 can receive a signal representative of the second moisture level and compare the signal to a benchmark value. For example, the benchmark value can represent an adequately wetted (e.g., not over-wetted and not under-wetted) second moisture panel 215. The controller 325 can determine that the second moisture level is greater than, less than, or equal to the benchmark value. The controller 325 can be configured to receive the signal representative of the second moisture level from the second moisture pad. The controller 325 can receive a signal representative of the second moisture level and determine if the signal is within a range (e.g., 2%, 5%, 10%, etc.) of a target moisture level.

The controller 325 can be configured to control a supply of water to at least one of the first moisture panel 210 or the second moisture panel 215 (e.g., individually or in combination) in response to the signal representative of the moisture level. For example, the controller 325 can be configured to collectively control a supply of water to the first moisture panel 210 in response to the signal representative of the moisture level and control a supply of water to the second moisture panel 215 in response to the signal representative of the moisture level. For example, the controller 325 can decrease the supply of water to the one or more moisture pads in response to a signal that the moisture level is higher than a benchmark level. The controller 325 can decrease the supply of water to the one or more moisture pads in response to a signal that indicates the moisture level in the moisture pads exceeds the benchmark level. The controller 325 can increase the supply of water to the one or more moisture pads in response to a signal that the moisture level is lower than the benchmark level. The controller 325 can retain (e.g., maintain, hold constant, etc.) the supply of water to the moisture pads in response to a signal that the moisture pads is adequately wetted (e.g., not over-wetted and not under-wetted).

Individually, the controller 325 can be configured to control the supply of water to the first moisture panel 210 in response to the signal representative of the first moisture level. For example, the controller 325 can be configured to increase the supply of water to the first moisture panel 210 in response to the first moisture level being less than the benchmark value. The controller 325 can be configured to decrease the supply of water to the first moisture panel 210 in response to the first moisture level being greater than the benchmark value. The controller 325 can be configured to maintain the supply of water to the first moisture panel 210 in response to the first moisture level being equal to the benchmark value. The controller 325 can be configured to control the supply of water to the first moisture pad in response to the signal representative of the first moisture level. The controller 325 can be configured to control the supply of water to the first moisture pad in response to the signal representative of both the first moisture level and the second moisture level.

Also, the controller 325 can be configured to individually control the supply of water to the second moisture panel 215 in response to the signal representative of the second moisture level. For example, the controller 325 can be configured to increase the supply of water to the second moisture panel 215 in response to the second moisture level being less than the benchmark value. The controller 325 can be configured to decrease the supply of water to the second moisture panel 215 in response to the second moisture level being greater than the benchmark value. The controller 325 can be configured to maintain the supply of water to the second moisture panel 215 in response to the second moisture level being equal to the benchmark value. The controller 325 can be configured to control the supply of water to the second moisture pad in response to the signal representative of the second moisture level. The controller 325 can be configured to control the supply of water to the second moisture pad in response to the signal representative of both the first moisture level and the second moisture level.

The controller 325 can be configured to control the supply of water using a variable rate controller 330 (e.g., flow control valve, etc.). For example, the variable rate controller 330 can adjust the application rate of droplets to an optimal amount for each moisture panel or for a single moisture panel. For example, the variable rate controller 330 can provide a higher application rate of droplets to the first moisture panel 210 than to the second moisture panel 215. The variable rate controller 330 can provide a higher application rate of droplets to the first moisture panel 210 than to the second moisture panel 215 in response to a signal representative of the moisture level corresponding to the first moisture panel 210 being lower than a signal representative of the moisture level corresponding to the second moisture panel 215. The variable rate controller 330 can provide a higher application rate of droplets to a first portion of the first moisture panel 210 than to a second portion of the first moisture panel 210. The variable rate controller 330 can provide a higher application rate of droplets to a first portion of the first moisture panel 210 than to a second portion of the first moisture panel 210 in response to a signal representative of the moisture level corresponding to the first portion of the first moisture panel 210 being lower than a signal representative of the moisture level corresponding to the second portion of the first moisture panel 210.

In some embodiments, the controller 325 can be configured to supply a voltage to the nozzles of the first nozzle array 310 and the second nozzle array 315. The controller 325 can select the voltage so as to cause the first nozzle array 310 and the second nozzle array 315 to provide a target amount of electrostatically charged droplets. The controller 325 can select the voltage so as to cause the one or more spray nozzles to provide a target amount of electrostatically charged droplets. For example, the target amount of electrostatically charged droplets can include an amount of electrostatically charged droplets that does not cause excess water to leave the first moisture panel 210 and the second moisture panel 215.

In some embodiments, the controller 325 can be incorporated into a system level control device (such as a condensing unit rack controller) that is configured to operate the any or all other components of the system such as the evaporator, the compressor, the gas cooler, the receiver, and the expansion valve. For example, the controller 325 can be configured to operate the MT evaporators 12. The controller 325 can be configured to operate the LT evaporators 22. The controller 325 can be configured to operate the MT compressors 14. The controller 325 can be configured to operate the LT compressors 24. The controller 325 can be configured to operate the gas cooler/condenser 2. The controller 325 can be configured to operate the gas cooler 200. The controller 325 can be configured to operate the receiving tank 6. The controller 325 can be configured to operate the expansion valves 11.

Figure 4:
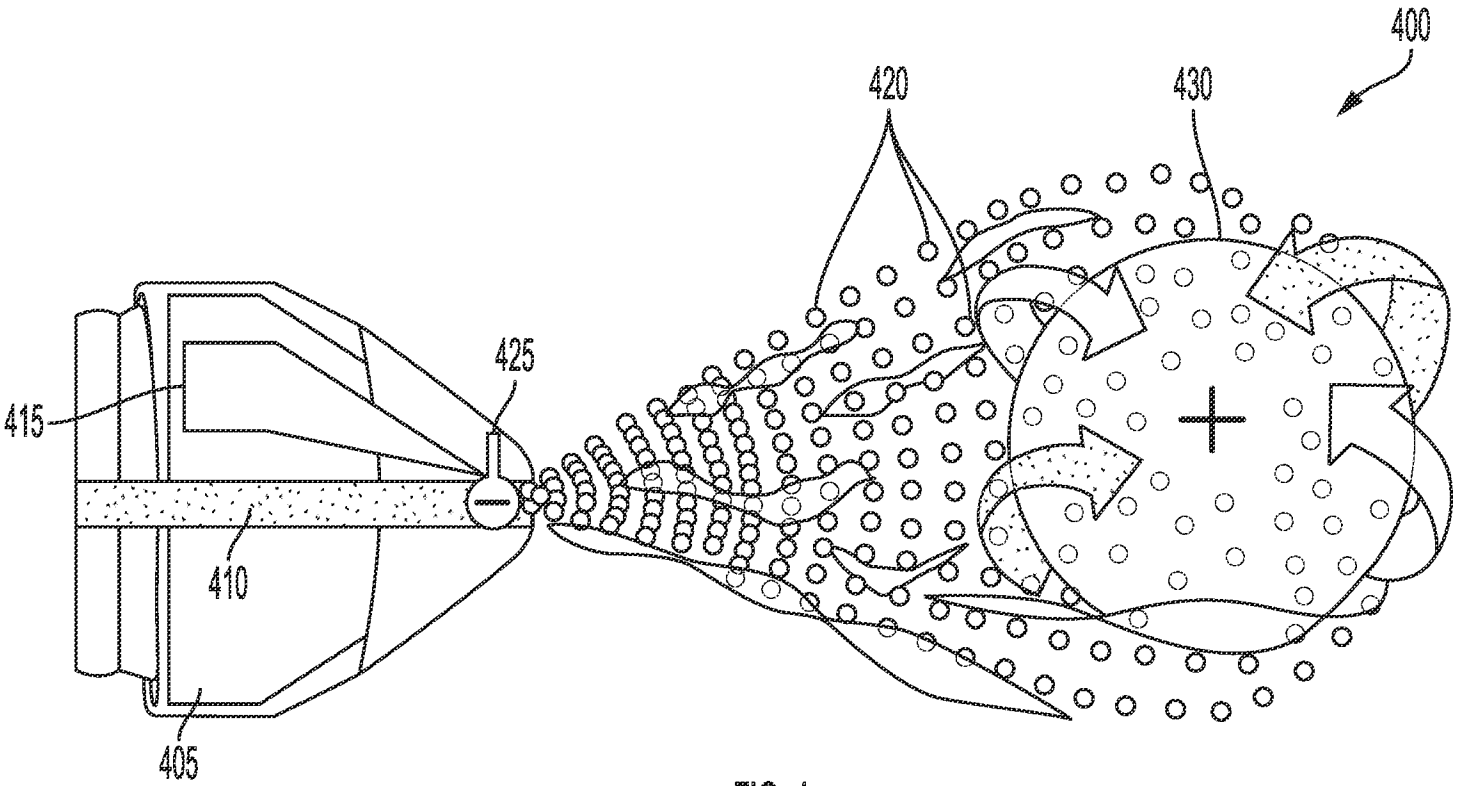
FIG. 4 is a schematic representation of an atomized spray of electrostatically charged droplets, according to an exemplary embodiment.

Referring now to FIG. 4, a schematic 400 of an atomized spray of electrostatically charged droplets is shown according to an exemplary embodiment. The first nozzle array 310 and the second nozzle array 315 each include a plurality of nozzles 405. The nozzles can include a liquid stream 410 (e.g., liquid line, etc.). The liquid stream 410 can include a stream of liquid (e.g., water, etc.). The nozzle 405 can also include an air stream 415 (e.g., air line, etc.). The air stream 415 can include a stream of air. The air stream 415 can be a laminar air stream when the air is inside the nozzle 405, and can be a turbulent air stream when the air exits the nozzle 405.

The liquid stream 410 and the air stream 415 can meet at a tip of the nozzle. For example, the low pressure and high volume air flow can atomize the liquid into droplets 420. The droplets 420 can be uniform in size. The droplets 420 can pass through an electric field. For example, an electrode 425 of the nozzle 405 can apply a charge (e.g., positive charge, negative charge, etc.) to the droplets 420. The droplets 420 can be carried towards a spray target 430 (e.g., first moisture panel 210, second moisture panel 215, etc.). The spray target 430 may have an opposite charge than that of the droplets 420. For example, the spray target 430 can have a positive charge and the droplets 420 can have a negative charge. Alternatively, the spray target 430 can have a negative charge and the droplets 420 can have a positive charge. The charged droplets 420 are attracted to the oppositely charged spray target 430.

Figure 5:
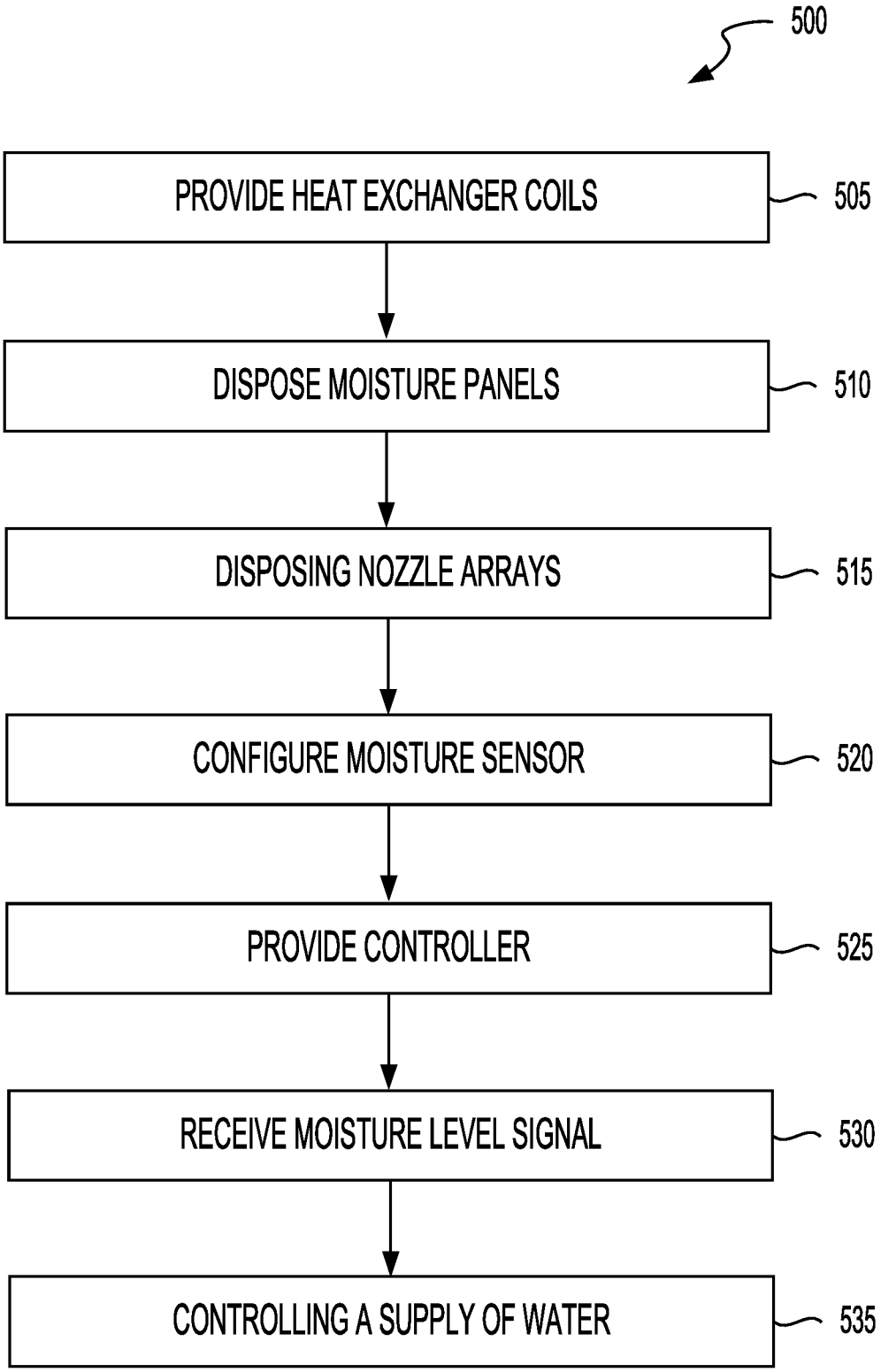
FIG. 5 is a block diagram of an example method of providing an evaporative gas cooler for a refrigeration system, according to an exemplary embodiment.

FIG. 5 is a block diagram of an example method 500 of providing an evaporative gas cooler for a $CO_2$ refrigeration system. In a similar manner, according to other embodiments, an adiabatic, evaporative cooler may be provided as a condenser or fluid cooler, etc. in a refrigeration system using other refrigerants, such as a hydrofluorocarbon or ammonia, etc. In brief summary, the method 500 can include providing heat exchanger coils 505. The method 500 can include installing moisture panels 510. The method 500 can also include installing nozzle arrays 515. The method 500 further includes configuring a moisture sensor 520, and providing a controller 525. The method 500 can also include receiving moisture level signals 530, and controlling a supply of water 535.

The method 500 can also include providing heat exchanger coils 505. The heat exchanger coil may include a microchannel coil, condenser coil, tube coil, cooling coil, or fin coil.

The method 500 further includes installing moisture panels 510, such as a first moisture panel external to the heat exchanger coil and a second moisture panel external to and near the heat exchanger coils.

The method 500 also includes installing nozzle arrays 515, such as a first nozzle array external to the first moisture panel and a second nozzle array external to the second moisture panel. The nozzle arrays provide an atomized spray of electrostatically charged droplets to the moisture panels.

The method 500 also includes installing a moisture sensor 520 to provide a signal representative of a moisture level from the first moisture panel and/or the second moisture panel (individually or in combination).

The method 500 also includes providing a controller 525 communicatively coupled to the moisture sensor. In some embodiments, the method 500 can include supplying, by the controller, a voltage to the first nozzle array and the second nozzle array. The method 500 can include selecting, by the controller, the voltage so as to cause the first nozzle array and the second nozzle array to provide a target amount of electrostatically charged droplets.

The method 500 can include receiving moisture level signals 530. Receiving moisture level signals can include receiving, by the controller, the signal representative of the moisture level from the first moisture panel and/or the second moisture panel.

The method 500 can include controlling a supply of water 535. Controlling a supply of water can include controlling, by the controller, a supply of water to one or both of the first moisture panel or the second moisture panel in response to the signal representative of the moisture level.

III. Example Operation of the Adiabatic Gas Cooler

Figure 6:
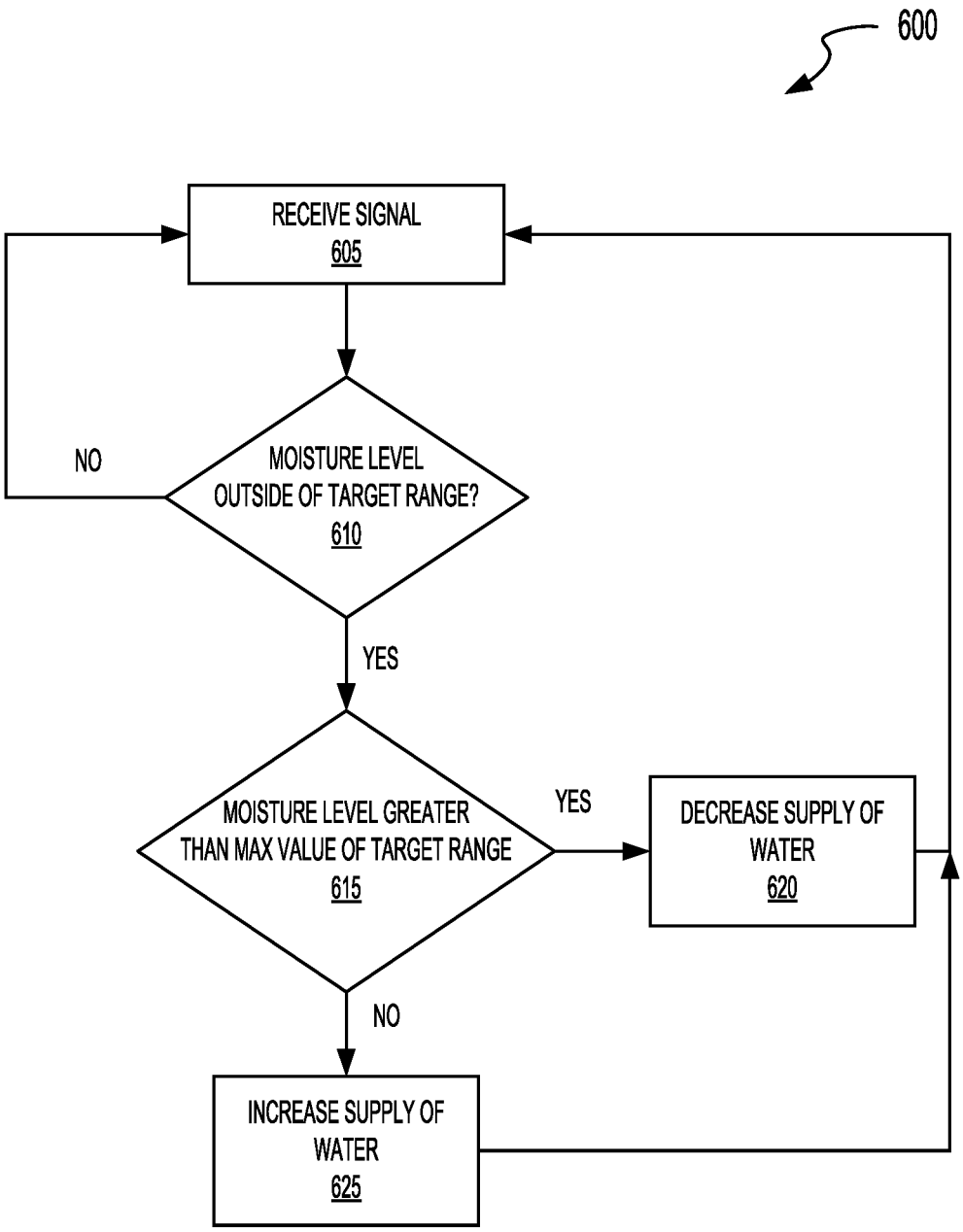
FIG. 6 is a block diagram of an example method of operating an adiabatic gas cooler, according to an exemplary embodiment.

FIG. 6 is a block diagram of an example method 600 of operating an adiabatic gas cooler. The method 600 can begin with receiving a signal by the controller 325. The signal can be representative of a moisture level from one or more moisture panels, such as a signal representative of a first moisture level from a first moisture panel and/or a signal representative of a second moisture level from a second moisture panel. The signal can also be representative of a moisture level from both a first moisture panel and a second moisture panel.

The method 600 continues with determining, by the controller 325, if the moisture level is within a range (e.g., 2%, 5%, 10%, etc.) of a target moisture level 610. If the controller 325 determines that the moisture level is within the range of the target moisture level, the method 600 restarts (e.g., ends and continues to block 605 again, etc.).

If the controller 325 determines that the moisture level is not within the range of the target moisture level, the method 600 continues in block 615 with determining, by the controller 325, if the moisture level is greater than the maximum value of the target range. If the controller 325 determines that the moisture level is greater than the maximum value of the target range, the method 600 continues in block 620 with decreasing, by the controller, the supply of water provided to the moisture panels. For example, the moisture level being greater than the maximum value of the target range may indicate that the moisture panels are receiving excess moisture. The method 600 then restarts (e.g., ends and continues to block 605 again, etc.).

If the controller 325 determines that the moisture level is not greater than the maximum value of the target range, the method 600 continues in block 625 with increasing, by the controller, the supply of water provided to the moisture panels. For example, the moisture level being less than the minimum value of the target range may indicate that the moisture panels are not receiving enough moisture. The method 600 then restarts (e.g., ends and continues to block 605 again, etc.).

IV. Construction of Example Embodiments

The construction and arrangement of the elements of the $CO_2$ refrigeration system with an adiabatic electrostatic gas cooler as shown in the exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

Any references to implementations or elements or acts of the systems and methods herein referred to in the singular can include implementations including a plurality of these elements, and any references in plural to any implementation or element or act herein can include implementations including only a single element. References in the singular or plural form are not intended to limit the presently disclosed systems or methods, their components, acts, or elements to single or plural configurations. References to any act or element being based on any information, act or element may include implementations where the act or element is based at least in part on any information, act, or element.

Any implementation disclosed herein may be combined with any other implementation, and references to "an implementation," "some implementations," "an alternate implementation," "various implementations," "one implementation" or the like are not necessarily mutually exclusive and are intended to indicate that a particular feature, structure, or characteristic described in connection with the implementation may be included in at least one implementation. Such terms as used herein are not necessarily all referring to the same implementation. Any implementation may be combined with any other implementation, inclusively or exclusively, in any manner consistent with the aspects and implementations disclosed herein.

References to "or" may be construed as inclusive so that any terms described using "or" may indicate any of a single, more than one, and all of the described terms. References to at least one of a conjunctive list of terms may be construed as an inclusive OR to indicate any of a single, more than one, and all of the described terms. For example, a reference to "at least one of 'A' and 'B'" can include only 'A', only 'B', as well as both 'A' and 'B'. Elements other than 'A' and 'B' can also be included.

The systems and methods described herein may be embodied in other specific forms without departing from the characteristics thereof. The foregoing implementations are illustrative rather than limiting of the described systems and methods.

Where technical features in the drawings, detailed description or any claim are followed by reference signs, the reference signs have been included to increase the intelligibility of the drawings, detailed description, and claims. Accordingly, neither the reference signs nor their absence have any limiting effect on the scope of any claim elements.

The systems and methods described herein may be embodied in other specific forms without departing from the characteristics thereof. The foregoing implementations are illustrative rather than limiting of the described systems and methods. Scope of the systems and methods described herein is thus indicated by the appended claims, rather than the foregoing description, and changes that come within the meaning and range of equivalency of the claims are embraced therein.

What is claimed is:

1. A cooling system, comprising:

at least one heat exchanger configured to receive a flow of a gas refrigerant and an ambient airflow;

at least one moisture panel disposed external to the at least one heat exchanger;

at least one nozzle disposed external to the at least one moisture panel and configured to distribute an electrostatically charged liquid to the at least one moisture panel;

at least one fan positioned to circulate the ambient airflow through the at least one moisture panel and from the at least one moisture panel to and through the at least one heat exchanger; and a controller configured to perform operations comprising:

controlling a supply of the electrostatically charged liquid to the at least one nozzle;

selecting an electrical parameter value so as to cause the at least one nozzle to distribute a target amount of electrostatically charged liquid to the at least one moisture panel; and supplying the selected electrical parameter value to the at least one nozzle.

2. The cooling system of claim 1, wherein the controller is configured to control the supply of the electrostatically charged liquid to the at least one nozzle based at least in part on a signal from a moisture sensor that is representative of a moisture level of the at least one moisture panel.

3. The cooling system of claim 2, wherein the moisture sensor is positioned at or near a bottom of the at least one moisture panel.

4. The cooling system of claim 3, wherein the moisture sensor is positioned to sense the moisture level at or near a drainage receptacle disposed beneath the at least one moisture panel.

5. The cooling system of claim 2, wherein the controller is configured to perform operations comprising:

(i) determining that the moisture level of the at least one moisture panel is outside of a predetermined moisture level range based on the signal;

(ii) based on the determination in (i), determining that the moisture level is greater than a maximum value of the predetermined moisture level range; and (iii) based on the determination in (ii), decreasing the supply of the electrostatically charged liquid to the at least one nozzle.

6. The cooling system of claim 5, wherein the controller is configured to perform operations comprising:

(iv) based on the determination in (i), determining that the moisture level is less than a minimum value of the predetermined moisture level range; and (v) based on the determination in (iv), increasing the supply of the electrostatically charged liquid to the at least one nozzle.

7. The cooling system of claim 1, wherein the distributed electrostatically charged liquid and the at least one moisture panel are oppositely charged.

8. The cooling system of claim 1, wherein the operation of controlling the supply of the electrostatically charged liquid to the at least one nozzle comprises:

controlling a flow control valve to control the supply of the electrostatically charged liquid to the at least one nozzle.

9. A method for cooling a refrigerant; comprising:

circulating a gas refrigerant through at least one heat exchanger of a cooling device;

during circulation of the refrigerant, distributing an electrostatically charged liquid through at least one nozzle to at least one moisture panel positioned external and adjacent to the at least one heat exchanger;

wetting at least a portion of the at least one moisture panel with the electrostatically charged liquid;

flowing, with at least one fan, an ambient airflow through the wetted portion of the at least one moisture panel to cool the ambient airflow; flowing, with the at least one fan, the cooled ambient airflow through the heat exchanger to cool the circulating gas refrigerant;

selecting an electrical parameter value so as to cause the at least one nozzle to distribute a target amount of electrostatically charged liquid to the at least one moisture panel; and supplying the selected electrical parameter value to the at least one nozzle.

10. The method of claim 9, further comprising:

determining a moisture level of the at least one moisture panel; and controlling a supply rate of the electrostatically charged liquid to the at least one nozzle based at least in part on the determined moisture level of the at least one moisture panel.

11. The method of claim 10, wherein determining the moisture level of the at least one moisture panel comprises:

determining the moisture level of the at least one moisture panel at or near a bottom of the at least one moisture panel.

12. The method of claim 11, wherein determining the moisture level of the at least one moisture panel at or near the bottom of the at least one moisture panel comprises:

determining the moisture level of the at least one moisture panel at or near a drainage receptacle disposed beneath the at least one moisture panel.

13. The method of claim 10, further comprising:

(i) determining that the moisture level of the at least one moisture panel is outside of a predetermined moisture level rang;

(ii) based on the determination in (i), determining that the moisture level is greater than a maximum value of the predetermined moisture level range; and (iii) based on the determination in (ii), decreasing the supply of the electrostatically charged liquid to the at least one nozzle.

14. The method of claim 13, further comprising:

(iv) based on the determination in (i), determining that the moisture level is less than a minimum value of the predetermined moisture level range; and (v) based on the determination in (iv), increasing the supply of the electrostatically charged liquid to the at least one nozzle.

15. The method of claim 9, wherein the distributed electrostatically charged liquid and the at least one moisture panel are oppositely charged.

16. The method of claim 9, wherein distributing the electrostatically charged liquid through the at least one nozzle comprises controlling a flow control valve to control a supply of the electrostatically charged liquid to the at least one nozzle.

17. A method of providing a cooling device for a refrigeration system, comprising:

providing at least one heat exchanger configured to receive a flow of a gas refrigerant and an ambient airflow;

installing at least one moisture panel external to the at least one heat exchanger;

installing at least one nozzle external to the at least one moisture panel;

configuring the at least one nozzle to provide a flow of electrostatically charged liquid to the at least one moisture panel; and providing a controller configured to control a supply of the electrostatically charged liquid to the at least one nozzle, wherein the at least one moisture panel is configured to be oppositely charged to the electrostatically charged liquid.

18. The method of claim 17, further comprising:

supplying an electrical signal from the controller to the at least one nozzle; and operating the at least one nozzle to provide the flow of electrostatically charged liquid to the at least one moisture panel based on the supplied electrical signal.

19. The method of claim 18, further comprising:

selecting, with the controller, the electrical signal based on a target amount of the electrostatically charged liquid to be provided to the at least one moisture panel.

20. The method of claim 17, further comprising:

receiving, at the controller, a moisture level of the at least one moisture panel from a moisture sensor in fluid communication with the at least one moisture panel; and controlling, with the controller, the supply of the electrostatically charged liquid to the at least one nozzle based on the received moisture level.

21. A cooling system, comprising:

at least one heat exchanger configured to receive a flow of a gas refrigerant and an ambient airflow;

at least one moisture panel disposed external to the at least one heat exchanger;

at least one nozzle disposed external to the at least one moisture panel and configured to distribute an electrostatically charged liquid to the at least one moisture panel, where the distributed electrostatically charged liquid and the at least one moisture panel are oppositely charged;

at least one fan positioned to circulate the ambient airflow through the at least one moisture panel and from the at least one moisture panel to and through the at least one heat exchanger; and a controller configured to perform operations comprising controlling a supply of the electrostatically charged liquid to the at least one nozzle.

22. The cooling system of claim 21, wherein the controller is configured to control the supply of the electrostatically charged liquid to the at least one nozzle based at least in part on a signal from a moisture sensor that is representative of a moisture level of the at least one moisture panel.

23. The cooling system of claim 22, wherein the moisture sensor is positioned at or near a bottom of the at least one moisture panel.

24. The cooling system of claim 23, wherein the moisture sensor is positioned to sense the moisture level at or near a drainage receptacle disposed beneath the at least one moisture panel.

25. The cooling system of claim 22, wherein the controller is configured to perform operations comprising:

(i) determining that the moisture level of the at least one moisture panel is outside of a predetermined moisture level range based on the signal;

(ii) based on the determination in (i), determining that the moisture level is greater than a maximum value of the predetermined moisture level range; and (iii) based on the determination in (ii), decreasing the supply of the electrostatically charged liquid to the at least one nozzle.

26. The cooling system of claim 25, wherein the controller is configured to perform operations comprising:

(iv) based on the determination in (i), determining that the moisture level is less than a minimum value of the predetermined moisture level range; and (v) based on the determination in (iv), increasing the supply of the electrostatically charged liquid to the at least one nozzle.

27. The cooling system of claim 21, wherein the controller is configured to perform operations comprising:

selecting an electrical parameter value so as to cause the at least one nozzle to distribute a target amount of electrostatically charged liquid to the at least one moisture panel; and supplying the selected electrical parameter value to the at least one nozzle.

28. The cooling system of claim 21, wherein the operation of controlling the supply of the electrostatically charged liquid to the at least one nozzle comprises:

controlling a flow control valve to control the supply of the electrostatically charged liquid to the at least one nozzle.

29. A method for cooling a refrigerant; comprising:

circulating a gas refrigerant through at least one heat exchanger of a cooling device;

during circulation of the refrigerant, distributing an electrostatically charged liquid through at least one nozzle to at least one moisture panel positioned external and adjacent to the at least one heat exchanger, wherein the distributed electrostatically charged liquid and the at least one moisture panel are oppositely charged;

wetting at least a portion of the at least one moisture panel with the electrostatically charged liquid;

flowing, with at least one fan, an ambient airflow through the wetted portion of the at least one moisture panel to cool the ambient airflow; and flowing, with the at least one fan, the cooled ambient airflow through the heat exchanger to cool the circulating gas refrigerant.

30. The method of claim 29, further comprising:

determining a moisture level of the at least one moisture panel; and controlling a supply of the electrostatically charged liquid to the at least one nozzle based at least in part on the determined moisture level of the at least one moisture panel.

31. The method of claim 30, wherein determining the moisture level of the at least one moisture panel comprises:

determining the moisture level of the at least one moisture panel at or near a bottom of the at least one moisture panel.

32. The method of claim 31, wherein determining the moisture level of the at least one moisture panel at or near the bottom of the at least one moisture panel comprises:

determining the moisture level of the at least one moisture panel at or near a drainage receptacle disposed beneath the at least one moisture panel.

33. The method of claim 30, further comprising:

(i) determining that the moisture level of the at least one moisture panel is outside of a predetermined moisture level range based on the signal;

(ii) based on the determination in (i), determining that the moisture level is greater than a maximum value of the predetermined moisture level range; and (iii) based on the determination in (ii), decreasing the supply of the electrostatically charged liquid to the at least one nozzle.

34. The method of claim 33, further comprising:

(iv) based on the determination in (i), determining that the moisture level is less than a minimum value of the predetermined moisture level range; and (v) based on the determination in (iv), increasing the supply of the electrostatically charged liquid to the at least one nozzle.

35. The method of claim 29, further comprising:

selecting an electrical parameter value so as to cause the at least one nozzle to distribute a target amount of electrostatically charged liquid to the at least one moisture panel; and supplying the selected electrical parameter value to the at least one nozzle.

36. The method of claim 29, wherein distributing the electrostatically charged liquid through the at least one nozzle comprises:

controlling a flow control valve to control a supply of the electrostatically charged liquid to the at least one nozzle.

* * * * *